US007544087B2

(12) United States Patent
Homer et al.

(10) Patent No.: US 7,544,087 B2
(45) Date of Patent: Jun. 9, 2009

(54) ELECTRONIC DEVICE INTERCONNECT SYSTEM

(75) Inventors: Steven S. Homer, Houston, TX (US); Earl W. Moore, Houston, TX (US); Hugh D. Waddell, Houston, TX (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/413,347

(22) Filed: Apr. 28, 2006

(65) Prior Publication Data

US 2007/0254523 A1 Nov. 1, 2007

(51) Int. Cl.
*H01R 12/24* (2006.01)

(52) U.S. Cl. ..... 439/492

(58) Field of Classification Search ..... 439/492, 439/260, 67, 79, 357, 267, 493–499, 358, 439/329

See application file for complete search history.

(56) References Cited

U.S. PATENT DOCUMENTS 3,555,493 A * 1/1971 Baumanis ..... 439/636
6,089,905 A * 7/2000 Shimmyo et al. ..... 439/495
6,116,927 A 9/2000 Johnson et al.
6,171,137 B1 1/2001 Hatakeyama
6,352,442 B1 3/2002 Kudo
6,471,541 B2 10/2002 Kunishi et al.
6,589,076 B1 7/2003 Davis et al.
6,773,287 B2 8/2004 Takashita
6,790,054 B1 * 9/2004 Boonsue ..... 439/79
6,837,740 B2 * 1/2005 Kunishi et al. ..... 439/495
6,851,968 B2 * 2/2005 Tsunematsu ..... 439/495
6,893,288 B2 5/2005 Tsunematsu
2006/0084311 A1 * 4/2006 Suzuki et al. ..... 439/260

* cited by examiner

*Primary Examiner*—Edwin A. Leon

(57) ABSTRACT

An electronic device interconnect system includes a connector member includes a plurality of connector pins configured to be communicatively coupled to a plurality of respective contact pads of a cable, at least one of the plurality of connector pins having a plurality of spaced apart connector elements, each of the connector elements configured to engage the respective contact pad corresponding to its connector pin.

17 Claims, 1 Drawing Sheet

ELECTRONIC DEVICE INTERCONNECT SYSTEM

BACKGROUND OF THE INVENTION

An interface connection point on an electronic device (e.g., the point at which two or more components or portions of the electronic device are communicatively coupled together) is oftentimes susceptible to failure. For example, when flexible cables are inserted into a printed circuit board (PCB) side connector, over time, the connection between the carbon flex of the cable and the connector pins on the connector becomes unstable (e.g., due to relative movement, bending, etc.), thereby resulting in an intermittent connection or complete loss of the connection.

BRIEF DESCRIPTION OF THE DRAWINGS

For a more complete understanding of the present invention, and the objects and advantages thereof, reference is now made to the following descriptions taken in connection with the accompanying drawings in which.

DETAILED DESCRIPTION OF THE DRAWINGS

Figure 1:
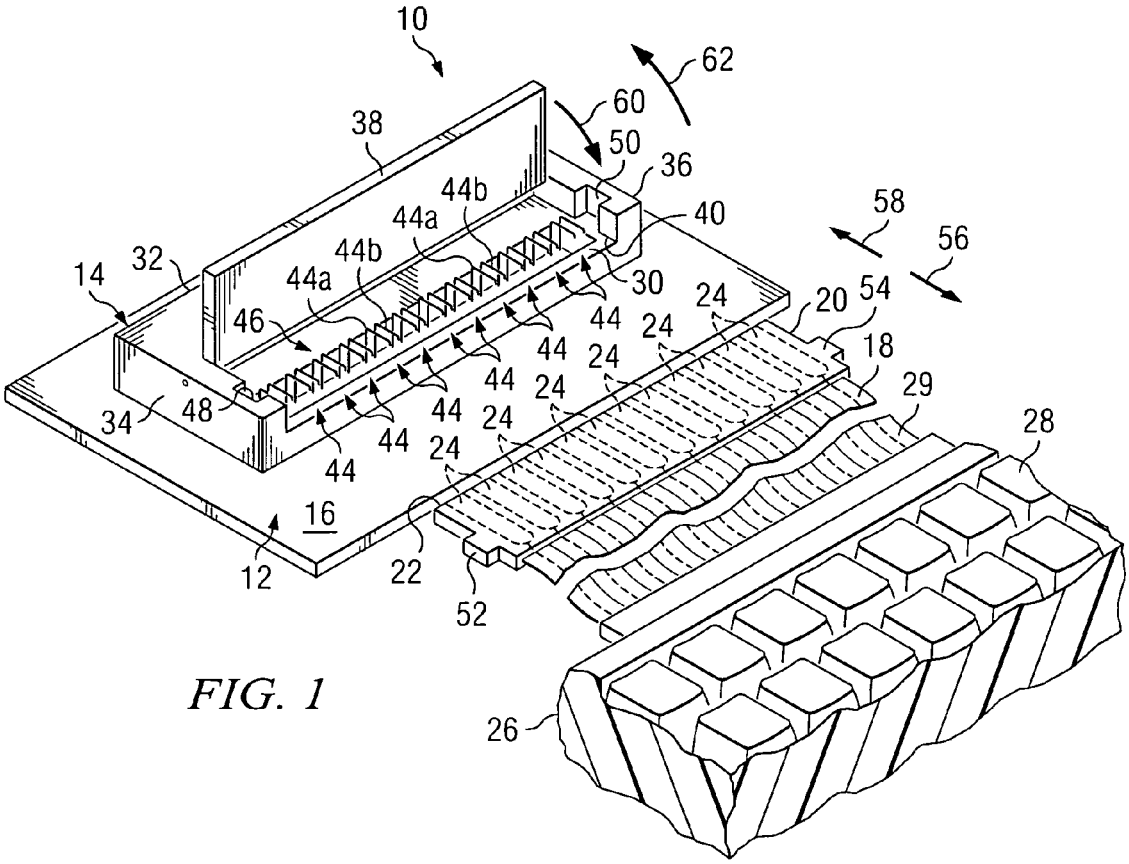
FIG. 1 is a diagram illustrating an embodiment of an electronic device interconnect system in accordance with the present invention.
Figure 2:
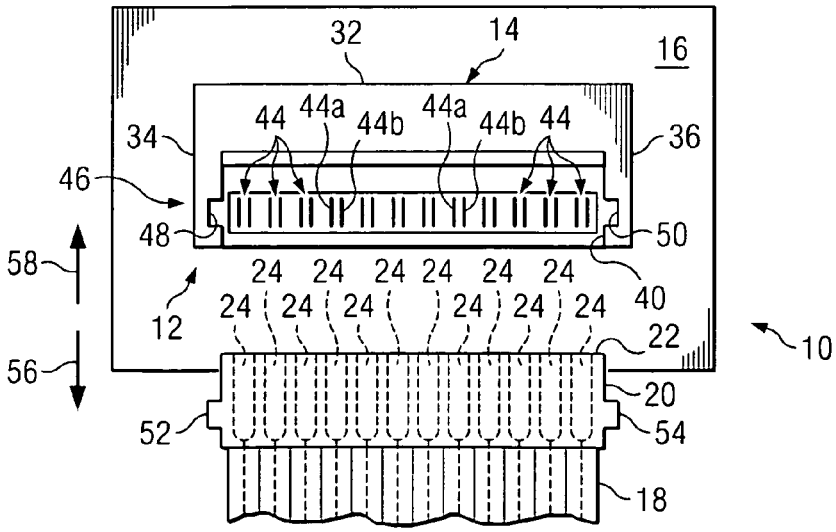
FIG. 2 is a top view of the electronic device interconnect system of FIG. 1.

The preferred embodiments of the present invention and the advantages thereof are best understood by referring to FIGS. 1 and 2 of the drawings, like numerals being used for like and corresponding parts of the various drawings.

FIG. 1 is a diagram of an electronic device interconnect system 10 in accordance with the present invention. In the embodiment illustrated in FIG. 1, system 10 comprises a connector member 12 configured to receive a cable 18. In the embodiment illustrated in FIG. 1, connector member 12 comprises a side connector 14, such as a zero insertion force (ZIF) side connector, disposed on a printed circuit board 16. It should be understood that other types of connector members 12 may be used such as, but not limited to, a low insertion force (LIF) connector. Connector member 12 is preferably used in connection with an electronic device such as, but not limited to, a notebook or laptop computer, a desktop computer, a tablet computer, a printer, a copier, a facsimile device, a multi-function imaging device or a personal digital assistant.

In the embodiment illustrated in FIG. 1, cable 18 comprises a flexible printed circuit (FPC) cable 20 having a first end 22 comprising a plurality of conductive contact pads 24 to be communicatively coupled to connector member 12. However, it should be understood that different types of cables may be used. In the embodiment illustrated in FIG. 1, cable 18 is coupled to a component 26 for use with the electronic device. In the embodiment illustrated in FIG. 1, component 26 comprises a keyboard 28 such that a portion of a carbon printed mylar contact layer 29 of keyboard 28 extends beyond keyboard 28 to form cable 18; however, it should be understood that other types of cables may be used in connection with any type of component 26 that is communicatively couplable to an electronic device, such as, but not limited to, a hard disk drive, optical media drive, etc.

In the embodiment illustrated in FIG. 1, connector member 12 comprises a base wall 30 couplable to PCB 16, a rear wall 32, a pair of sidewalls 34 and 36, and a pivotable actuator 38 extending between sidewalls 34 and 36 forming and/or otherwise defining a chamber 40 to receive first end 22 of cable 18. In the embodiment illustrated in FIG. 1, connector member 12 comprises connector pins 44 disposed on base wall 30 such that when first end 22 of cable 18 is inserted within chamber 40, contact pads 24 contact connector pins 44 to facilitate communication between component 26 and the electronic device.

In the embodiment illustrated in FIG. 1, connector member 12 comprises a locking mechanism 46 for preventing relative movement between connector member 12 and cable 18. Locking mechanism 46 comprises a recess 48 disposed on sidewall 34 and a recess 50 disposed on sidewall 36. Recesses 48 and 50 are configured to receive a pair of extensions 52 and 54, respectively, when cable 18 is disposed within chamber 40. Locking mechanism 46 is configured to restrict relative movement between cable 18 and connector member 12 based on extensions 52 and 54 disposed within recesses 48 and 50, respectively, (e.g., restricts relative movement in the direction of arrows 56 and 58). In addition, extensions 52 and 54 provide additional assurance that conductive pads 24 are aligned with and otherwise disposed adjacent to corresponding connector pins 44 to facilitate communication therebetween.

In operation, after first end 22 of cable 18 is inserted within chamber 40, actuator 38 is pivoted in the direction of arrow 60 such that actuator 38 enagages first end 22 of cable 18 and presses and/or forces contact pads 24 against connector pins 44 and retains cable 18 within connector member 12 so that cable 18 remains in communicative engagement with connector member 12. To remove cable 18 from connector member 12, actuator 38 is pivoted in the direction indicated by arrow 62 away from cable 18 first end 22, thereby enabling first end 22 of cable 18 to be lifted from chamber 40.

FIG. 2 is a top view of interconnect system 10 of FIG. 1 in accordance with the present invention. In the embodiment illustrated in FIG. 2, one or more connector pins 44 each comprise at least two connector elements (e.g., a connector element 44*a* and a connector element 44*b*); however, it should be understood that a greater number of connector elements may be used for each connector pin 44. According to embodiments of the present invention, connector pins 44 are spaced apart from each other on connector member 12 such that each connector pin 44 is aligned with and contacts a single corresponding conductive pad 24 on cable 18 when cable 18 is disposed within chamber 40 of connector member 12. Further, connector elements 44*a* and 44*b* are spaced apart from each other for each connector pin 44 while remaining within a contact area of a corresponding conductive pad 24. Thus, in the illustrated embodiment, each pair of connector elements 44*a* and 44*b* for a particular connector pin 44 is aligned with and configured to engage a single contact pad 24 on cable 18.

Thus, embodiments of the present invention provide a redundant or secondary contact to each pad 24 of cable 18, thereby reducing the likelihood of a connection loss between cable 18 and connector member 12. For example, each connector pin 44 comprises a primary connector element (e.g., connector element 44*a*) and a secondary or redundant connector element (e.g., connector element 44*b*) corresponding to each contact pad 24 of cable 18. Thus, embodiments of the present invention provide greater contact reliability between connector member 12 and cable 18, especially for carbon printed mylar-type cables 18 (e.g., providing at least two contact points for each carbon flex trace on the carbon printed mylar cable). Additionally, embodiments of the present invention provide a locking mechanism (e.g., locking mechanism 46) to secure cable 18 within connector member 12, thereby reducing the likelihood of contact loss due to vibration or other movement-related causes.

What is claimed is:

1. An electronic device interconnect system, comprising:

a plurality of conductors forming a cable, wherein each conductor has a contact pad disposed on a first end thereof, and wherein each contact pad has a first side and a second side; and a connector member having a plurality of pins disposed thereupon, wherein each pin comprises a plurality of discrete contact elements, and wherein each pin is communicatively coupled to the first side of a corresponding pad by the plurality of discrete contact elements when the cable is coupled to the connector member.

2. The system of claim 1, wherein the connector member comprises a pivotable actuator configured to secure the cable to the connector member.

3. The system of claim 1, wherein the connector member comprises a locking mechanism configured to secure the cable to the connector member.

4. The system of claim 1, wherein the cable comprises one or more tabs and wherein the connector member comprises at least one recess configured to receive the one or more tabs.

5. The system of claim 1, wherein the connector member comprises an actuator to apply a contact force to the connector pins and the contact pads.

6. The system of claim 1, wherein the cable comprises a carbon printed mylar contact layer.

7. The system of claim 1, wherein the cable comprises a carbon printed mylar contact layer of a keyboard.

8. A method of manufacturing an electronic device interconnect system, comprising:

providing a plurality of conductors forming a cable, wherein each conductor has a contact pad disposed on a first end thereof, and wherein each contact pad has a first side and a second side; and providing a connector member having a plurality of pins disposed thereupon, wherein each pin comprises a plurality of discrete contact elements, and wherein each pin is communicatively coupled to the first side of a corresponding pad by the plurality of discrete contact elements when the cable is coupled to the connector member.

9. The method of claim 8, further comprising providing a pivotable actuator configured to secure the cable to the connector member.

10. The method of claim 8, further comprising providing a locking mechanism on the connector member to secure the cable to the connector member.

11. The method of claim 8, further comprising disposing one or more tabs on the cable and providing at least one corresponding recess on the connector member configured to receive the one or more tabs.

12. The method of claim 8, further comprising providing an actuator configured to apply a contact force to the connector pins and the contact pads.

13. The method of claim 8, further comprising configuring the cable as a carbon printed mylar contact layer.

14. The method of claim 8, further comprising configuring the cable as a carbon printed mylar contact layer of a keyboard.

15. An interconnect system for an electronic device, comprising:

a plurality of conductors configured to form a ribbon cable, wherein each conductor has a contact pad disposed on a first end thereof, and wherein each contact pad has a first side and a second side; and wherein one or more tabs are disposed on or about the first end of the ribbon cable; and a connector member having a plurality of pins disposed thereupon, wherein the plurality of pins are configured to accommodate a ribbon cable, and wherein each pin comprises a plurality of discrete contact elements, and wherein each pin is communicatively coupled to the first side of a corresponding pad by the plurality of discrete contact elements when the cable is coupled to the connector member, and wherein the connector comprises an actuator to apply force to the ribbon cable to promote electrical contact between the plurality of pins disposed on the connector and the corresponding plurality of pads disposed on the ribbon cable, and wherein the connector comprises one or more recesses to accommodate the one or more tabs disposed on or about the first end of the ribbon cable.

16. The system of claim 15, wherein the ribbon cable comprises a carbon printed mylar contact layer.

17. The system of claim 15, wherein the ribbon cable comprises a carbon printed mylar contact layer of a keyboard.

* * * * *